United States Patent [19]

Blough

[11] Patent Number: 4,869,236

[45] Date of Patent: Sep. 26, 1989

[54] APPARATUS FOR COLLECTING AND STORING GREASE DISCHARGED FROM ROOF MOUNTED EXHAUST SYSTEMS

[76] Inventor: John W. Blough, 607 North St., Brandon, Miss. 39042

[21] Appl. No.: 197,047

[22] Filed: May 20, 1988

[51] Int. Cl.[4] ..... F24C 15/20

[52] U.S. Cl. ..... 126/299 R; 126/299 E; 55/DIG. 36; 210/162; 210/163; 210/188; 210/540

[58] Field of Search ..... 126/299 R, 299 D, 299 E, 126/299 F, 299 C; 55/DIG. 36; 210/162, 163, 188, 540

[56] References Cited

U.S. PATENT DOCUMENTS

| | | | |
|---|---|---|---|
| 1,732,315 | 10/1929 | Ray | 126/299 D |
| 2,793,712 | 5/1957 | Graswich et al. | 126/299 D |
| 2,874,627 | 2/1959 | Simmonds | 126/299 D |
| 3,393,497 | 7/1968 | Donnelly | 126/299 D |
| 3,563,005 | 2/1971 | Jones | 126/299 E |
| 3,984,505 | 10/1976 | Gutermuth et al. | 126/299 E |
| 4,635,617 | 1/1987 | Simonsen | 126/299 E |

*Primary Examiner*—James C. Yeung

*Attorney, Agent, or Firm*—Dewitt L. Fortenberry, Jr.

[57] ABSTRACT

This invention is an apparatus which collects and stores grease discharged from exhaust fan systems of commercial kitchens. There is a means for collecting the grease which is adjustable so that it can be attached to fit most any size commercial exhaust fan. Once the grease is collected, it flows into a means for storing the grease. The means for storing the grease is releasably supported by means for collecting the grease. Thus, the means for storing the grease can be released, the stored grease removed, and then re-attached to the means for collecting the grease. The invention also includes a means for discharging rain water that is collected by the means for collecting grease. Any water which is collected is discharged into the drainage pipe located on the restaurant roof.

2 Claims, 3 Drawing Sheets

APPARATUS FOR COLLECTING AND STORING GREASE DISCHARGED FROM ROOF MOUNTED EXHAUST SYSTEMS

SUMMARY OF THE INVENTION

This invention relates to a device for collecting grease that is discharged from a roof mounted exhaust fan system used to ventilate kitchen areas. More specifically, the device consists of a catch basin for collecting grease which drips from the exhaust fan and a grease extractor for storing the grease collected by the catch basin. The invention is adjustable to fit most commercial roof mounted exhaust fan systems. It is also simple in design and construction so that grease can be easily disposed of to prevent the accumulation of grease on the roof of the kitchen.

In the restaurant business, grease is one of the most commonly used ingredients for cooking. Grease is also a natural by-product of cooking since fats, oils, meats and sauces all give off a certain amount of grease in vapor form. That grease often clings to the surface of the exhaust system as it cools and rises out of the kitchen. Thus, grease will drip from the exhaust fan system and collect on the roof. This build-up of grease on the roof of commercial kitchens is especially dangerous because of the resulting fire hazard. Additionally, accumulation of grease on the roof results in the destruction of some types of roofing materials.

Over the years restaurant owners have used several devices to collect and dispose of grease as it is exhausted from a restaurant kitchen. One such device is shown in U.S. Pat. No. 4,635,617 as well as the patents cited therein. Those patents rely basically on some type of a detergent or solvent system to collect and dispose of the grease. However, such systems are often complicated and not practical. Additionally, numerous restaurants still allow the grease to collect on the roof surrounding the exhaust system.

This invention is unique in that it provides a simple and reliable solution to the problem of how to collect and store grease removed from the kitchen by the exhaust fan. Generally, the invention comprises a catch basin in communication with an extractor which is releasably attached to the catch basin.

The catch basin is a square trough that is attached to the housing curb of an exhaust fan. In this position, the basin catches the grease which drips from the exhaust fan. The basin is also slideably adjustable so that it can be attached to almost any size roof mounted exhaust fan system.

The extractor is a rectangular shaped container having three internal compartments and a removable cover. The extractor is releasably mounted to the catch basin. As grease is collected by the catch basin, the grease flows through a pipe and into the extractor where it is stored. The extractor also includes a drain pipe for discharging water that is collected by the catch basin. When the extractor is filled with grease, it is removed from the basin. After removing the cover, the grease is poured out, the cover replaced, and the extractor reattached to the basin.

It is, therefore, an object of this invention to provide a device for collecting the grease discharged from the exhaust fan of a restaurant kitchen.

Another object of this invention is to provide a device which is adjustable to fit any size commercial exhaust fan.

Yet another object of this invention is to provide a device for storing grease once it is collected.

It is also an object of this invention to collect grease so that the grease may be recycled.

An object of this invention is to also provide a device which is simple in design and can easily be manufactured and assembled.

It is an object of this invention to provide a means to dispose of rain water collected.

Another object of this invention is to reduce the fire hazard resdulting from grease collecting on the roof of a restaurant kitchen.

These objects together with other objects and advantages will become apparent after review of the drawings and detailed description of the invention as more fully hereinafter described and claimed.

A BRIEF DESCRIPTION OF THE DRAWINGS

Referring now to the drawings, wherein like referenced characters refer to like parts throughout the several views, and wherein.

DETAILED DESCRIPTION OF THE INVENTION

Figure 1:
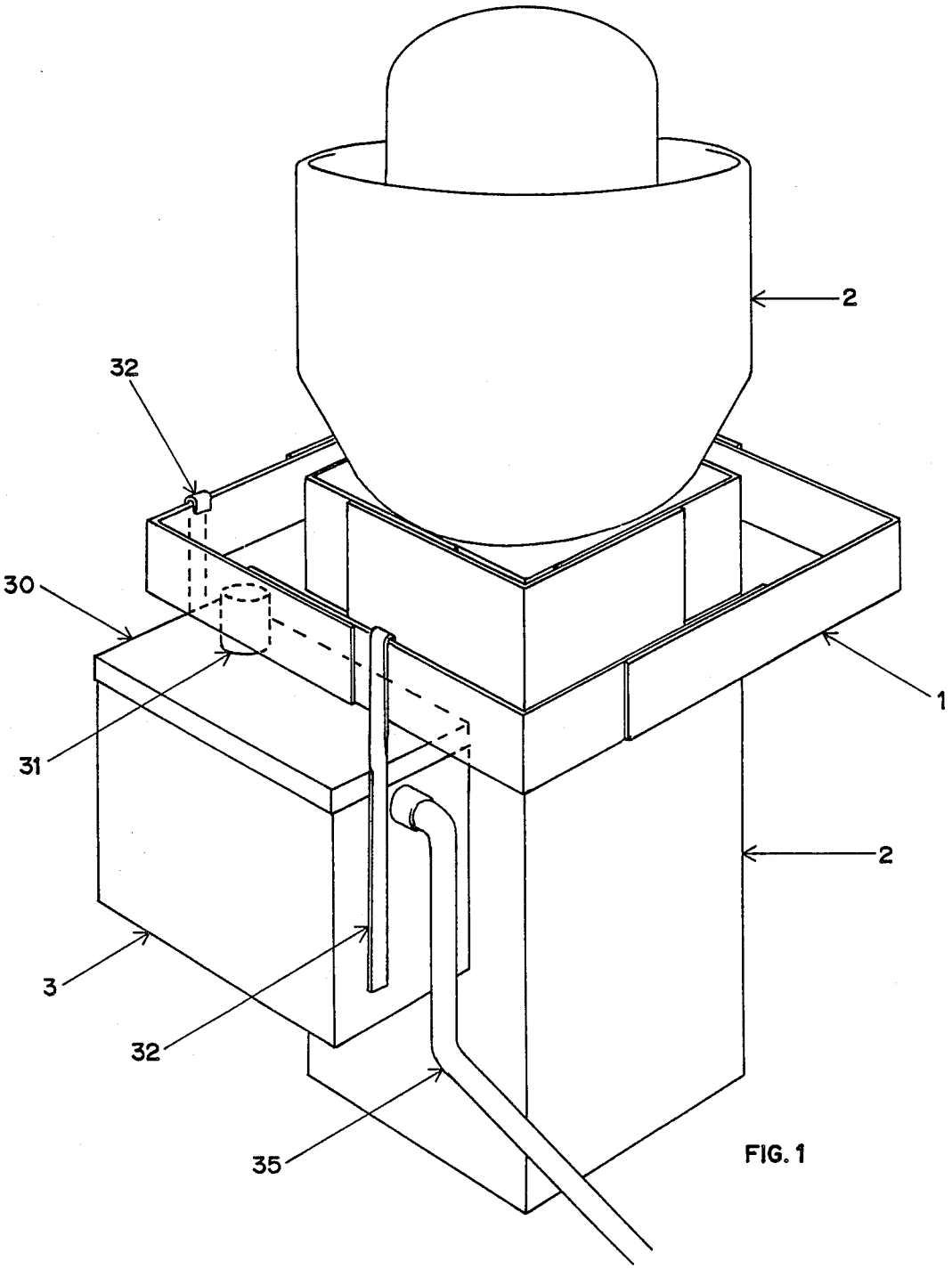
FIG. 1 is a view of the invention attached to an exhaust fan extending from the roof of a restaurant kitchen.

Referring to FIG. 1, the invention consists of a means for collecting grease shown as a catch basin 1 attachable to an exhaust fan 2 extending from the roof of a commercial kitchen, and an extractor 3. The extractor 3 has a removeable cover 30. The cover 30 includes a passageway shown as a pipe 31 which provides a means for the flow of grease and other liquids from the basin 1 to the extractor 3. A plurality of hooks 32 are secured to the extractor 3. The hooks 32 are such that they may be attached to the side of the basin 1 so that the extractor 3 is releaseably supported by the basin 1.

Figure 2:
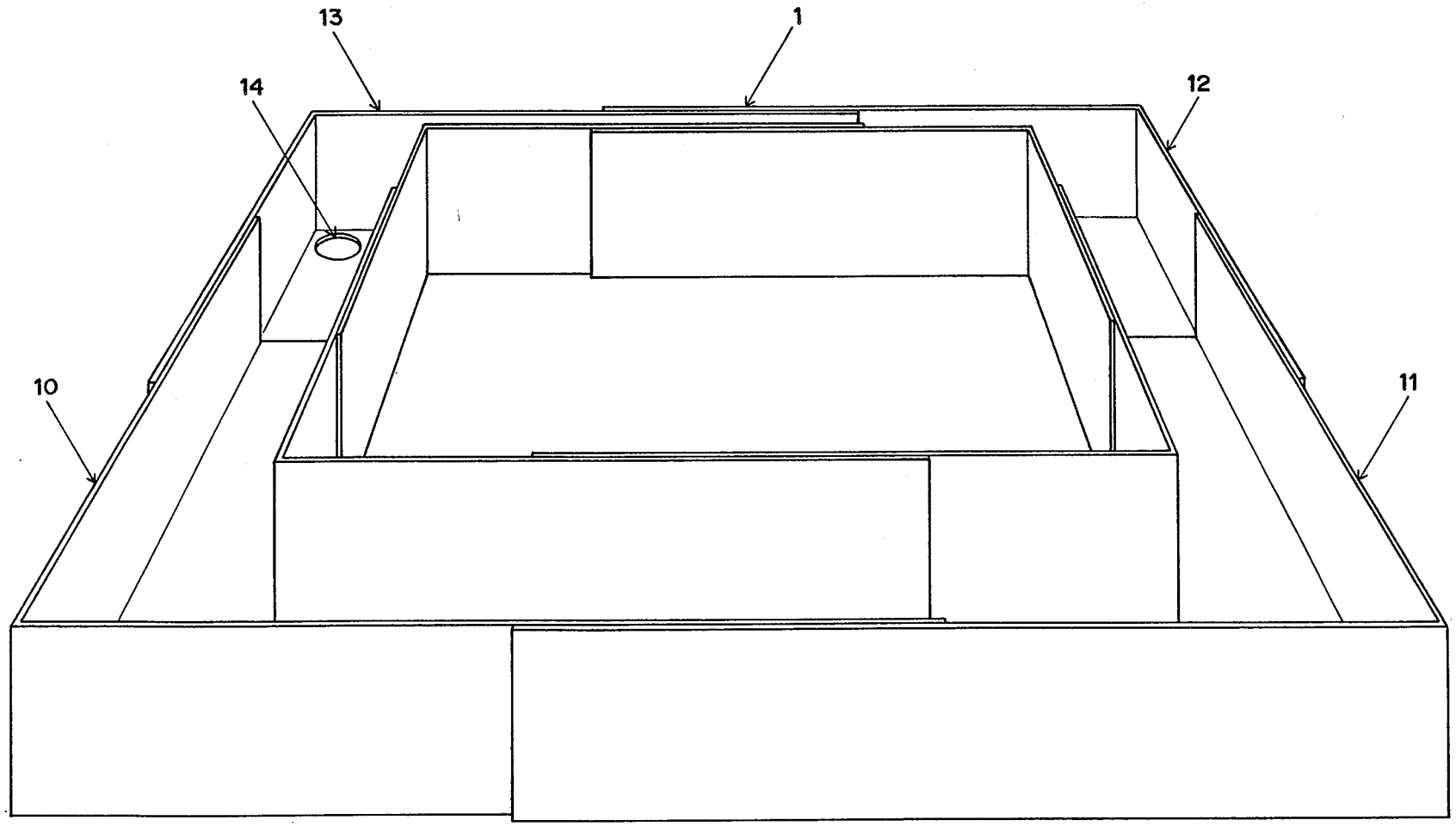
FIG. 2 is a view of the slideably adjustable catch basin.

Referring to FIG. 2, the basin 1 consists of four L-shaped, channel troughs 10, 11, 12 and 13. When the troughs 10, 11, 12, and 13 are positioned as shown in FIG. 2, around the housing curb of a fan, the troughs can be pushed together or pulled apart so that the basin can be adjusted to fit most any size exhaust fan. It should be noted that one of the troughs forming the basin 1 has an outlet 14 which releasably accepts the pipe 31 so that as grease or rain water is collected by the basin 1, it will flow into the outlet 14, through the pipe 31 and into the extractor 3.

Figure 3:
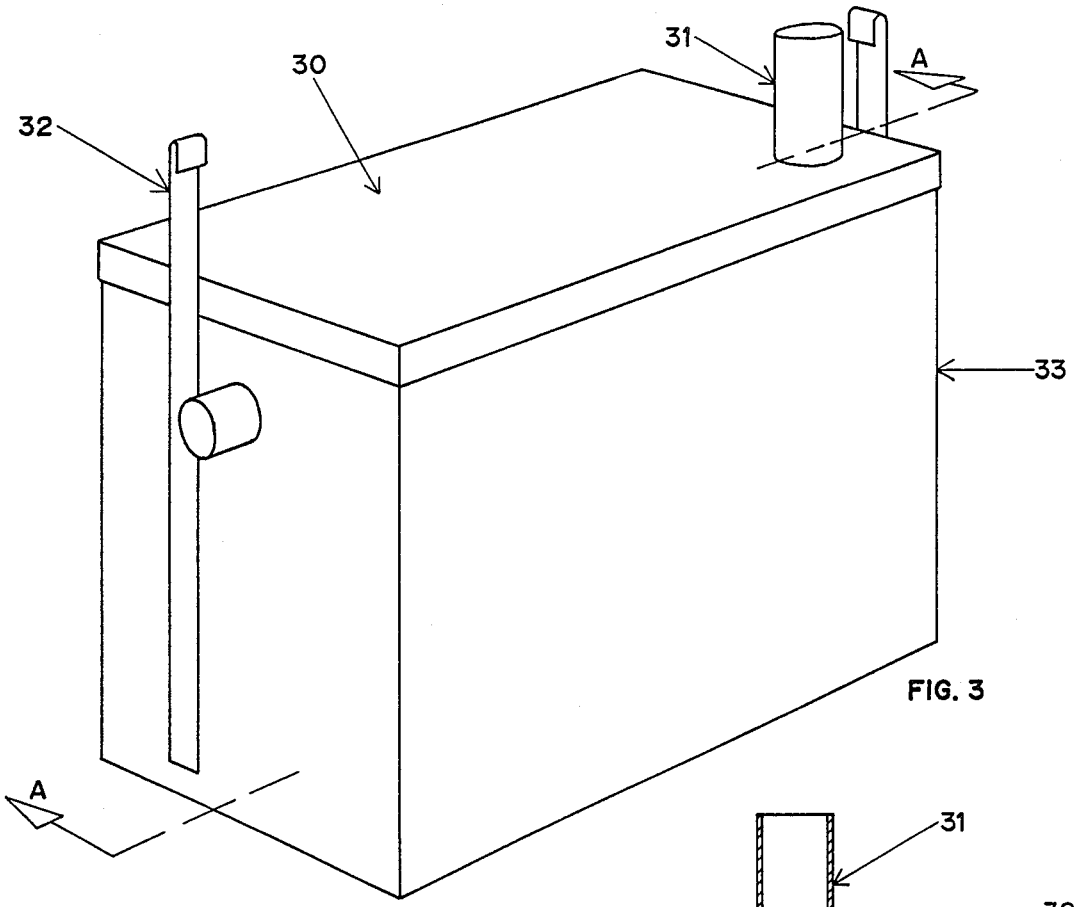
FIG. 3 is a view of the extractor.
Figure 4:
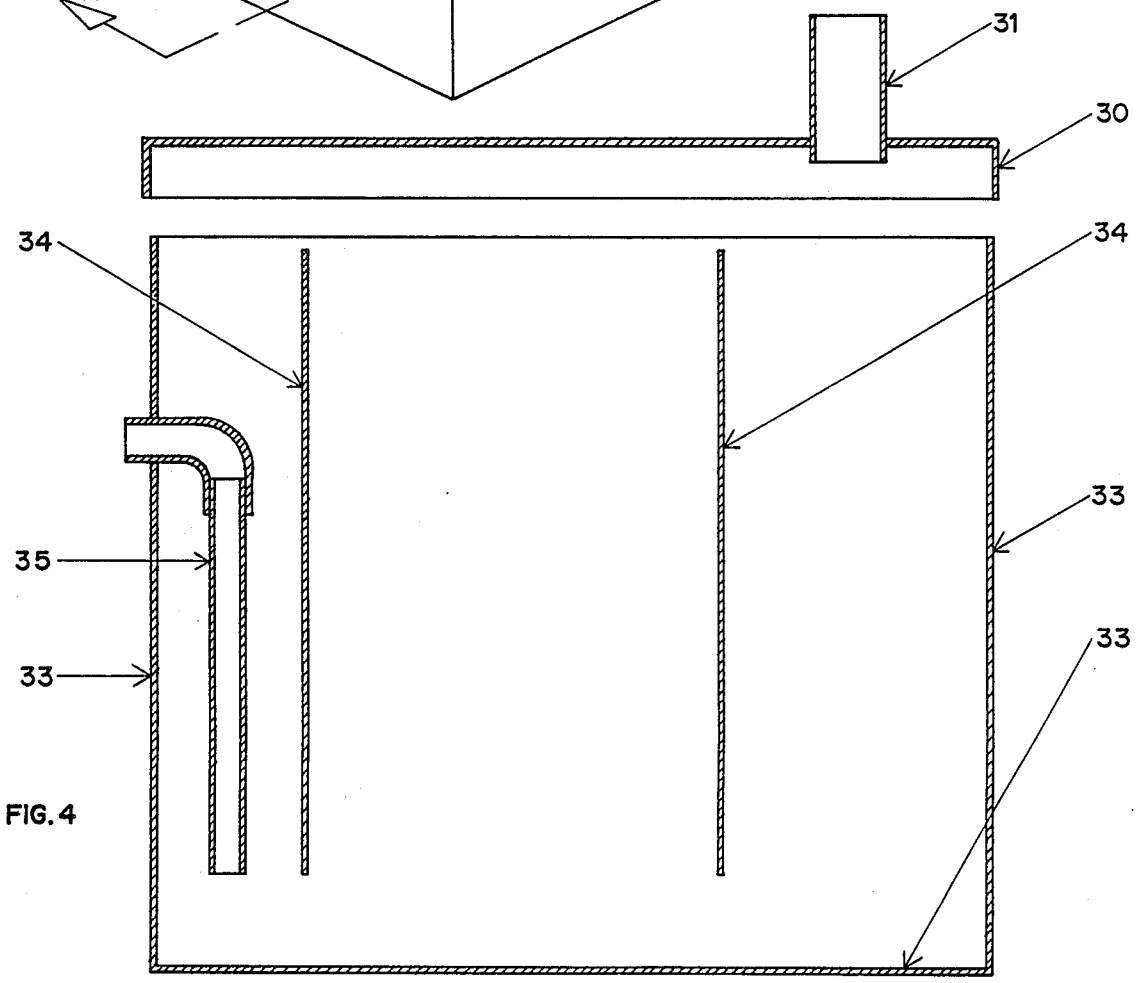
FIG. 4 is a cut-way of the extractor as shown along line A—A in FIG. 3.

Referring to FIGS. 3 and 4, the extractor 3 consists of a body 33 having a plurality of dividers 34 which divide the inside of the extractor 3 into three chambers. The dividers 34 serve as a means for limiting the circulation of grease or rain water entering the extractor 3 from the pipe 31.

The body 33 of the extractor 3 also has a means for discharging water, shown as a drain conduit 35 which extends into the extractor 3 to a point just above the bottom surface of the body 33. The drain conduit 35 can be extended as shown in FIG. 1 to the drain pipe (not shown) on the roof of the building so as to provide a conduit for discharging the water collected.

As can be seen, the construction of the invention is such that it is easy to install, use, and service. When air is exhausted from the kitchen area of the restaurant, it includes grease from the cooking operations. As the air flows from the exhaust fan 2, grease is collected on the exhaust fan 2 and drips into the basin 1. The grease will then flow into the outlet 14 through the pipe 31 and into the extractor 3 where it is collected.

It should be noted that as rainwater is also collected in the basin 1, the water will also flow into the extractor 3. Because of the inherent properties of grease and water, each will separate with the grease being on top of the water and when the extrator 3 is sufficiently full, the grease will force any water collected to flow through the drain conduit 35 which extends into the body 33 of the extractor 3. The grease will therefore remain in the extractor and any rain water removed before the extractor is filled to capacity.

When it is time to empty the grease from the extractor 3, the pipe 31 is disconnected from the outlet 14 of the basin 1 and the extractor 3 lifted up to disengage the hooks 32 from the side of basin 1. The cover 30 is then removed from the extractor 3 which is then emptied into a bucket or other appropriate container. The cover 30 can then be placed back onto the extractor 3 which is reattached to the basin 1 and the pipe 31 re-connected to the outlet 14 in order to continue collecting grease.

Although particular components have been discussed with the specific embodiment of the invention, other components may be utilized in accordance with the teachings of the present invention. Furthermore, it is understood that although an exemplary embodiment of the invention has been disclosed, other application and mechanical arrangements are possible and the embodiment disclosed may be subjected to various changes, modifications, and substitutes without departing from the spirit of the invention.

What is claimed is:

1. In apparatus for collecting and storing grease discharged from a roof mounted exhaust fan system having an exhaust housing positioned and exposed on a roof, comprising:

an adjustable catch basin for collecting said grease, said basin consisting a multiplicity of interconnecting slidable trough members, each of each trough members being attached to the outer periphery of said exhaust housing;

an extractor for storing said grease, hook means for releasably securing said extractor to said adjustable catch basin; and pipe means for connecting said adjustable catch basin and said extractor for discharging the grease and any rainwater from the adjustable catch basin into the extractor.

2. An apparatus for collecting and storing grease discharge from a roof mounted exhaust fan system having an exhaust housing positioned and exposed on a roof, comprising:

an adjustable catch basin for collecting said grease, said basin consisting a multiplicity of interconnecting slidable trough members, each of each trough members being attached to the outer periphery of said exhaust housing;

an extractor for storing said grease, hook means for releasably securing said extractor to said adjustable catch basin; and pipe means for connecting said adjustable catch basin and said extractor for discharging the grease and any rainwater from the adjustable catch basin into the extractor, and said extractor having first means for discharging rainwater collected by said adjustable catch basin and said means for limiting the circulation of grease or rainwater contained in said extractor.

* * * * *